US009139032B2

(12) United States Patent
Kawaguchi et al.

(10) Patent No.: US 9,139,032 B2
(45) Date of Patent: Sep. 22, 2015

(54) ADJUSTABLE HEATING DEVICE FOR USE IN AN ERASING APPARATUS

(71) Applicants: KABUSHIKI KAISHA TOSHIBA, Tokyo (JP); TOSHIBA TEC KABUSHIKI KAISHA, Tokyo (JP)

(72) Inventors: Takahiro Kawaguchi, Shizuoka (JP); Jun Ishii, Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/155,179

(22) Filed: Jan. 14, 2014

(65) Prior Publication Data

US 2015/0197112 A1 Jul. 16, 2015

(51) Int. Cl.

| | |
|---|---|
| ***B41J 2/325*** | (2006.01) |
| ***B41J 2/32*** | (2006.01) |
| ***B41J 2/315*** | (2006.01) |
| ***B41J 29/36*** | (2006.01) |
| *B41J 3/60* | (2006.01) |

(52) U.S. Cl.

CPC ... *B41J 29/36* (2013.01); *B41J 2/32* (2013.01); *B41J 3/60* (2013.01)

(58) Field of Classification Search

CPC combination set(s) only.
See application file for complete search history.

(56) References Cited

U.S. PATENT DOCUMENTS

| | | | | |
|---|---|---|---|---|
| 2013/0002782 | A1 | 1/2013 | Kawaguchi et al. | |
| 2013/0242025 | A1 * | 9/2013 | Yamaguchi | 347/179 |
| 2013/0267412 | A1 | 10/2013 | Kawaguchi | |

* cited by examiner

*Primary Examiner* — Lisa M Solomon
(74) *Attorney, Agent, or Firm* — Patterson & Sheridan, LLP

(57) ABSTRACT

A heating device includes first and second heating rollers and first and second pressing rollers. The first pressing roller and the second heating roller forms a first unit, and the second pressing roller and the first heating roller forms a second unit that is rotatable about a rotational axis relative to the first unit. The heating device also includes an eccentric shaft unit disposed on one of the first unit and the second unit and extending in a direction parallel to the rotational axis, a rotational position of an eccentric portion of the eccentric shaft unit being changeable, and an engaging unit disposed on the other one of the first unit and the second unit, and configured to engage with the eccentric shaft, a position of the second unit relative to the first unit being adjusted when the rotational position of the eccentric portion of the eccentric shaft unit is changed.

15 Claims, 14 Drawing Sheets

ADJUSTABLE HEATING DEVICE FOR USE IN AN ERASING APPARATUS

FIELD

Embodiments described herein relate generally to a heating device for use with an erasing apparatus.

BACKGROUND

An erasing apparatus performs an erasing processing on a sheet having an image by applying heat and pressure to the image. Such an erasing apparatus employs a heat roll-type heating method, in which a pair of rollers rotates while being heated. By passing through a contact portion of the rollers, the image on the sheet is heated and erased. In the erasing apparatus employing the heat roll-type heating method, a nip area is secured by urging one of the rollers towards the other one of the rollers, and a heat of the roller is transferred to the sheet.

In addition, there are some erasing apparatuses that employ two pairs of heating units, each having a heat roller and a press roller. In such an erasing apparatus, the first heating unit performs an erasing processing on one surface of the sheet and the second heating unit performs an erasing processing on the other surface of the sheet, so that both surfaces of the sheet may be erased during one-time sheet conveyance through the erasing apparatus.

In this type of erasing apparatus, if a sheet jam occurs at any of the heating units, a user pulls out the sheet by opening the erasing apparatus. In order to facilitate clearing of jams, the erasing apparatus employs a heating device opening and closing mechanism that causes the first heating unit and the second heating unit to be opened at the same time using a common rotating shaft as a rotational axis.

However, such a heating device opening and closing mechanism has a drawback in that it is difficult to optimize pressures applied in both of the first and second heating units because the pressure in the first heating unit is associated with the pressure in the second heating unit. In particular, the pressure in the second heating unit, which is disposed far from the rotating shaft, varies depending on sizes of members holding the heat roller or the press roller by a greater amount relative to the first heating unit.

DETAILED DESCRIPTION

A heating device includes a first heating roller configured to heat a first surface of a sheet, a second heating roller configured to heat a second surface of the sheet, the second heating roller disposed downstream in a sheet conveying direction with respect to the first heating roller, a first pressing roller configured to press the sheet against the first heating roller, the first pressing roller and the second heating roller forming a first unit, a second pressing roller configured to press the sheet against the second heating roller, the second pressing roller and the first heating roller forming a second unit that is rotatable about a rotational axis relative to the first unit, an eccentric shaft unit disposed on one of the first unit and the second unit and extending in a direction parallel to the rotational axis, a rotational position of an eccentric portion of the eccentric shaft unit being changeable, and an engaging unit disposed on the other one of the first unit and the second unit, and configured to engage with the eccentric shaft, a position of the second unit relative to the first unit being adjusted when the rotational position of the eccentric portion of the eccentric shaft unit is changed.

Hereinafter, description will be given with regard to embodiments in detail using drawings.

First Embodiment

Figure 1:
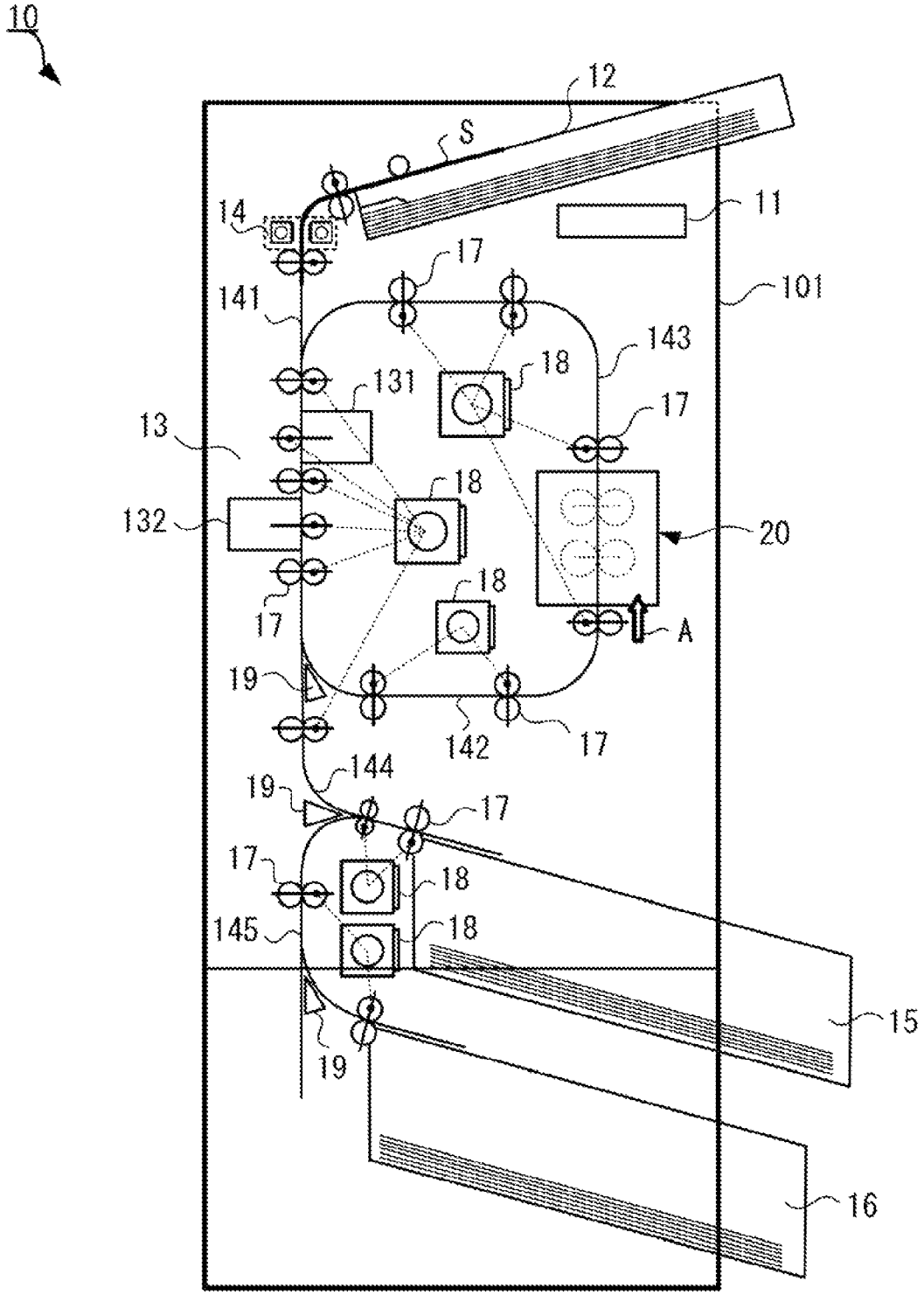
FIG. 1 is a schematic view illustrating an entire configuration example of an erasing apparatus to which a heating device according to a first embodiment is applied.

As illustrated in FIG. 1, an erasing apparatus 10 includes an operation panel 11 which includes an operation button and a display unit, a sheet feeding unit 12, a scanner 13 which is a reading unit, an ultrasonic sensor 14 which detects a conveying state of a sheet S, and a heating device 20 which erases an image on the sheet S. Furthermore, the erasing apparatus 10 includes a first sheet ejecting tray 15 and a second sheet ejecting tray (reject box) 16 which are sheet ejecting units, in addition to a first conveyance path 141, a second conveyance path 142, a third conveyance path 143, a fourth conveyance path 144, and a fifth conveyance path 145.

Along conveyance paths 141-145, a plurality of conveying rollers 17 to convey the sheet S are disposed, and a plurality of motors 18 are disposed to drive respective conveying rollers 17. In addition, the respective conveyance paths 141-145 are provided with a plurality of gates 19 in order to accurately convey the sheet S to the respective conveyance paths 141-145.

Along the first conveyance path 141, the sheet S is conveyed from the sheet feeding unit 12 to the scanner 13. Along the second conveyance path 142, the sheet S is conveyed from the scanner 13 to the heating device 20 in a direction indicated by an arrow A. Along the third conveyance path 143, the sheet S is conveyed from the heating device 20 to the scanner 13 again. Along the fourth conveyance path 144, the sheet S is conveyed from the scanner 13 to the first sheet ejecting tray 15. Along the fifth conveyance path 145, the sheet S is conveyed from the scanner 13 to the second sheet ejecting tray (reject box) 16.

The first sheet ejecting tray 15 stores a sheet S which can be reused, for example, after an image erasing processing. The second sheet ejecting tray (reject box) 16 stores a sheet S which cannot be reused and is recycled with normal disposal.

The erasing apparatus 10 generally performs the following operations (1) to (5).

(1) The sheet S fed from the sheet feeding unit 12 through the first conveyance path 141 is scanned by the scanner 13. The scanner 13 includes a first scanner 131 and a second scanner 132 and scans both surfaces of the sheet S. The scanner 13 reads out image data, for example, before an image of the sheet S is erased. At the same time, a printing status of the sheet S is determined based on the image data.

(2) Saving or the like of the image data read out by the scanner 13 is performed. If there is a wrinkle or a tear on the sheet S in view of the printing status acquired with the scanner 13, the sheet S is guided to the fifth conveyance path 145 and is conveyed to the reject box 16. The sheet S without any wrinkle or tear is conveyed to the heating device 20 through the second conveyance path 142.

(3) The sheet S conveyed to the heating device 20 is heated when passing through the heating device 20, an image formed on the sheet S is erased by heat. The heating device 20 erases the image on the sheet S by pressurizing and heating the sheet S, for example, at a relatively high temperature of 180° C. to 200° C. Description with regard to a specific configuration of the heating device 20 will be given below.

(4) The sheet S which has passed through the heating device 20 is conveyed to the scanner 13 again through the third conveyance path 143. The printing status is determined again based on the image scanned by the scanner 13 in order to confirm whether or not the image formed with a erasable color agent in an image area is surely erased.

(5) The sheet S which can be reused is conveyed to the first sheet ejecting tray 15 through the fourth conveyance path 144. If an image formed with a non-erasable color agent or an handwritten image remains in the image area, or an wrinkle or a tear occurs in view of the printing status acquired with the scanner 13, the sheet S is conveyed to the reject box 16 through the fifth conveyance path 145.

Figure 2:
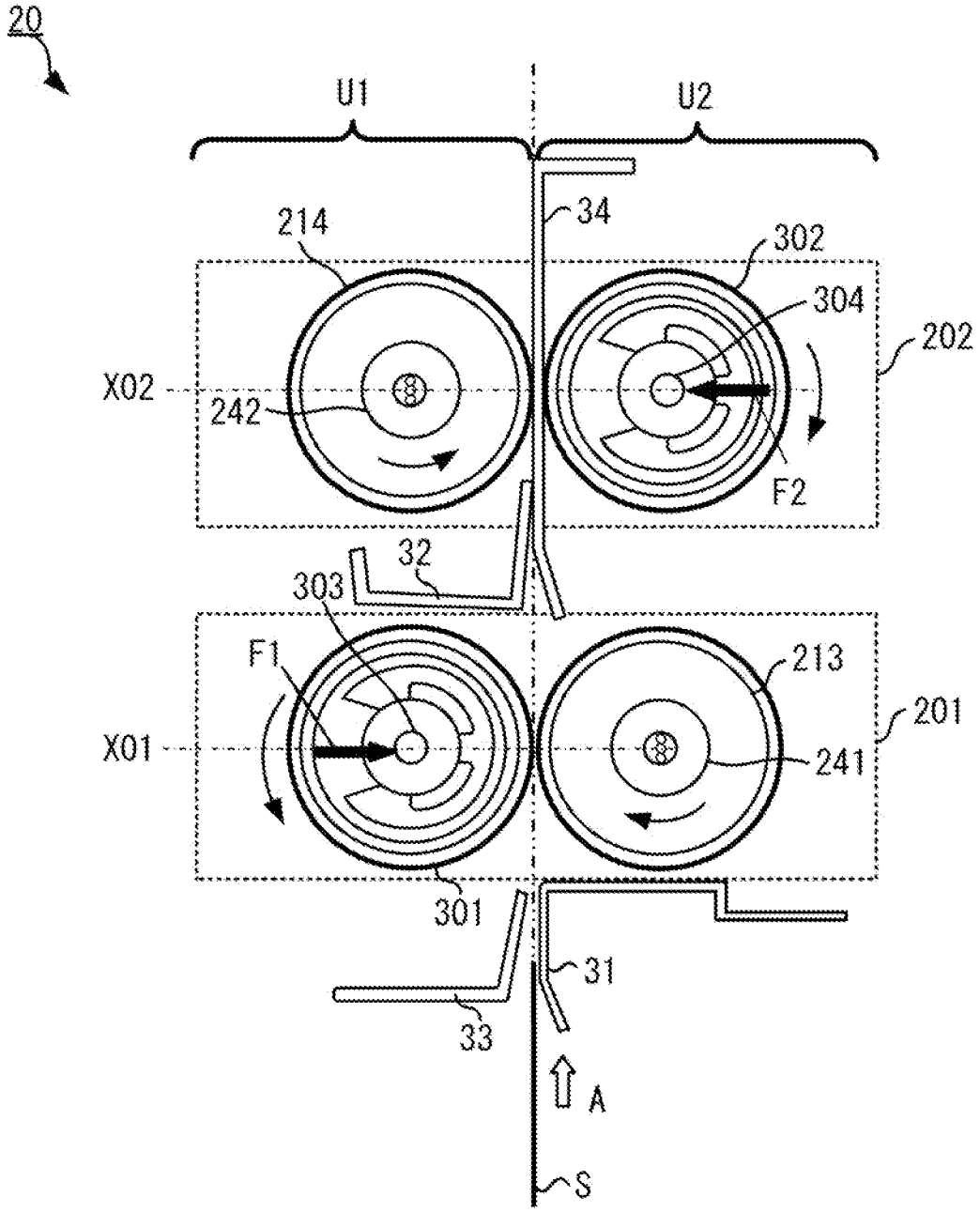
FIG. 2 is a cross-sectional view illustrating a specific example of an inside configuration of the heating device illustrated in FIG. 1.

The heating device 20 conveys the sheet S fed by the sheet feeding unit 12 through the conveyance path while heating the sheet S with a heat source having a predetermined temperature and erases the image on the sheet S. As illustrated in FIG. 2, the heating device 20 includes a heat source in each of a first erasing unit 201 and a second erasing unit 202. The first erasing unit 201 (first heat source) includes a first heat roller 213, which is a heating member, and a second press roller 301, which is a pressing member. In the same manner, the second erasing unit 202 (second heat source) includes a second heat roller 214 and a second press roller 302. In addition, the first erasing unit 201 and the second erasing unit 202 have substantially the same configurations, but the first erasing unit 201 and the second erasing unit 202 are flipped upside down. The first press roller 301 and the second press roller 302 are rotating rollers which respectively rotate around rotating shafts 303 and 304 and formed in a cylindrical shape which extends in a width direction of the sheet S.

The sheet S is conveyed along the second conveyance path 142 from the direction of the arrow A. The direction of the arrow A corresponds to the direction of the arrow A of FIG. 1. The first heat roller 213 and the second heat roller 214 respectively have a halogen heater 241 and a halogen heater 242, which are cylindrical. A sheet guide 31 is disposed at a sheet entering side of the first erasing unit 201, and a sheet guide 32 is disposed at a sheet exiting side the first erasing unit 201. The sheet guide 31 guides the sheet S entering the first erasing unit with a sheet guide 33. The sheet guide 33 opposes the sheet guide 31 and is fixed to the erasing apparatus 10. The sheet guide 32 guides the sheet S exiting the first erasing unit 201 with a sheet guide 34. The sheet guide 34 opposes the sheet guide 32 and is fixed to the erasing apparatus 10. The sheet guides 32 and 34 operate as guides when the sheet S is carried into the second erasing unit 202.

The first press roller 301 and the second press roller 302 are cylindrical rotating rollers which are respectively in contact with the first heat roller 213 and the second heat roller 214 in a longitudinal direction and respectively rotate around the rotating shafts 303 and 304. The first press roller 301 and the second press roller 302, for example, are formed by adhering a tube having a releasing property on a surface of an elastic body such as silicone sponge and the like. The sheet S is interposed between the first heat roller 213 and the first press roller 301 and between the second heat roller 214 and the second press roller 302 and is conveyed while being pressurized and heated by respectively urging the rotating shafts 303 and 304 towards the first heat roller 213 and the second heat roller 214.

A pressure (pinch pressure) which urges the first press roller 301 towards the first heat roller 213 is indicated as F1 in the first erasing unit 201. A pressure (pinch pressure) which urges the second press roller 302 towards the second heat roller 214 is indicated as F2 in the second erasing unit 202. A ratio of the pinch pressure F1 and the pinch pressure F2 is, for example, 3:2.

For example, the rotating shaft 303 is pulled to the first heat roller 213 by a spring in order to cause the pinch pressure F1. In addition, for example, the rotating shaft 304 is pulled to the second heat roller 214 by a spring in order to cause the pinch pressure F2.

Next, description will be given with regard to the erasing processing on the sheet S by the first erasing unit 201 and the second erasing unit 202. The sheet S is guided by the sheet guides 31 and 33 along the second conveyance path 142 and then is conveyed into the heating device 20. The sheet S is conveyed in the direction of the arrow A at a preset rate by the press roller 301 of the first erasing unit 201 and the press roller 302 of the second erasing unit 202 rotating in an opposite direction to each other.

The first press roller 301 is urged towards the first heat roller 213 and is brought into contact with the first heat roller 213 with the pinch pressure F1 in the first erasing unit 201 upstream of the conveyance path with respect to the second erasing unit 202. A nip area is formed at a contact region (chain line X01) of the first press roller 301 and the first heat roller 213, where heat is transferred to the sheet S. A sheet surface is heated while the sheet passes through the nip area X01, and then the image formed on one surface of the sheet S is erased.

If the image is formed on the sheet S with a erasable color agent, the color agent is decolorized when it reaches a predetermined temperature. The first heat roller 213 is uniformly heated by the cylindrical halogen heater 241 and is maintained at an erasable temperature. The temperature of the first heat roller 213 is detected by a thermistor (not illustrated) and is maintained at an appropriate temperature based on the detected temperature.

After the sheet S is ejected from the first erasing unit 201, the sheet S is guided by the sheet guides 32 and 34 and is conveyed into the second erasing unit 202. Top and bottom relation of the second press roller 302 and the second heat roller 214 is inverted from the first erasing unit 201, and the second press roller 302 is urged towards the second heat roller 214 and brought into contact with the second heat roller with the pinch pressure F2 in the second erasing unit 202 disposed downstream of the conveyance path with respect to the first erasing unit 201.

A nip area is formed in a contact region (chain line X02) of the second press roller 302 and the second heat roller 214, where heat is transferred to the sheet S. A sheet surface is heated while the sheet S passes through the nip area X02, and the image formed on the other surface of the sheet S is erased. The sheet S of which images on both surfaces are erased is ejected along the sheet guide 34, and is conveyed towards the third conveyance path 143.

The configurations of the first erasing unit 201 and the second erasing unit 202 are substantially the same. However, since the erasing units are flipped upside down and respective rollers are disposed in series state, one surface of the sheet S is erased by the first erasing unit 201 and the other surface of the sheet S is erased by the second erasing unit 202. Therefore, it is possible to effectively erase both sides of the sheet S.

In addition, though details will be described later, the heating device 20 of the present embodiment is configured to be divisible into two units with respect to a conveying path of the sheet as a border. When the heating device 20 is built into the erasing apparatus 10, the first press roller 301 and the second heat roller 214 are included in an inside unit U1 positioned inside. In addition, the first heat roller 213 and the second press roller 302 are included in an outside unit U2 positioned outside.

Figure 3:
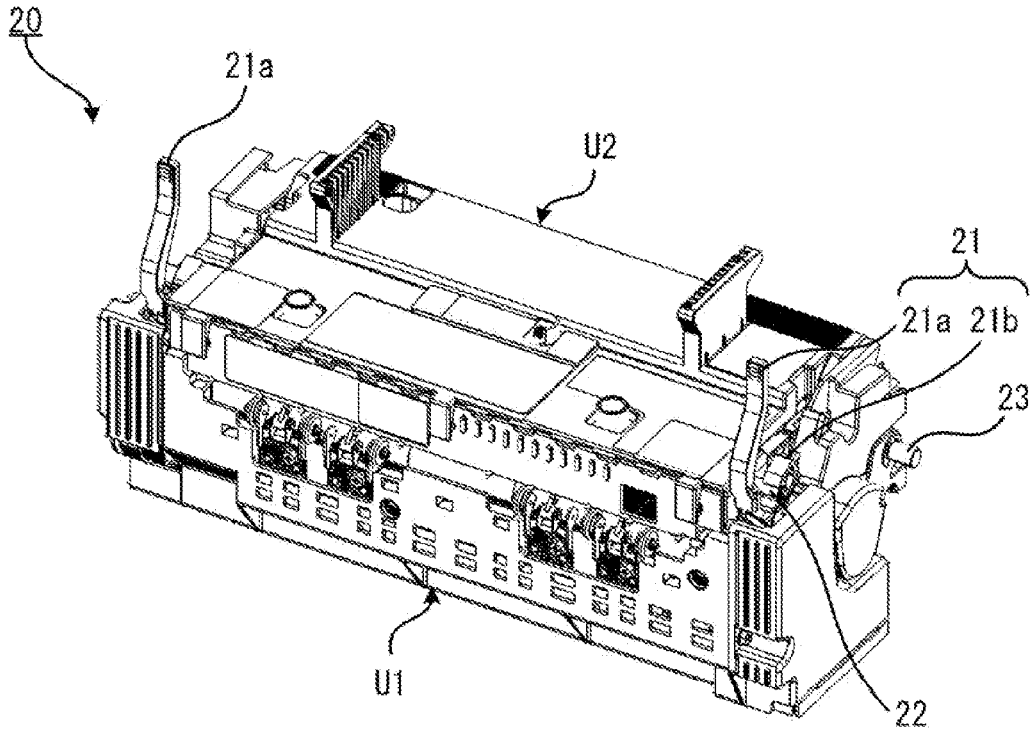
FIGS. 3 and 4 are perspective views of the heating device illustrated in FIG. 1 from different viewpoints.
Figure 4:
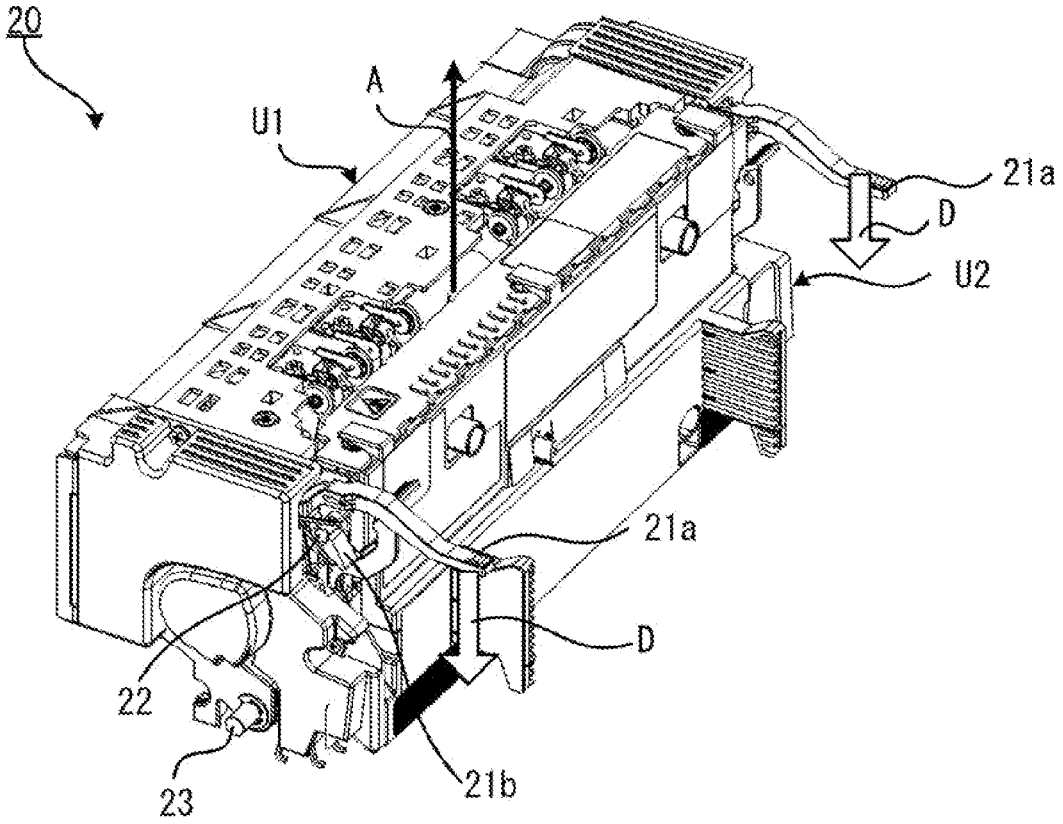
Figure 5:
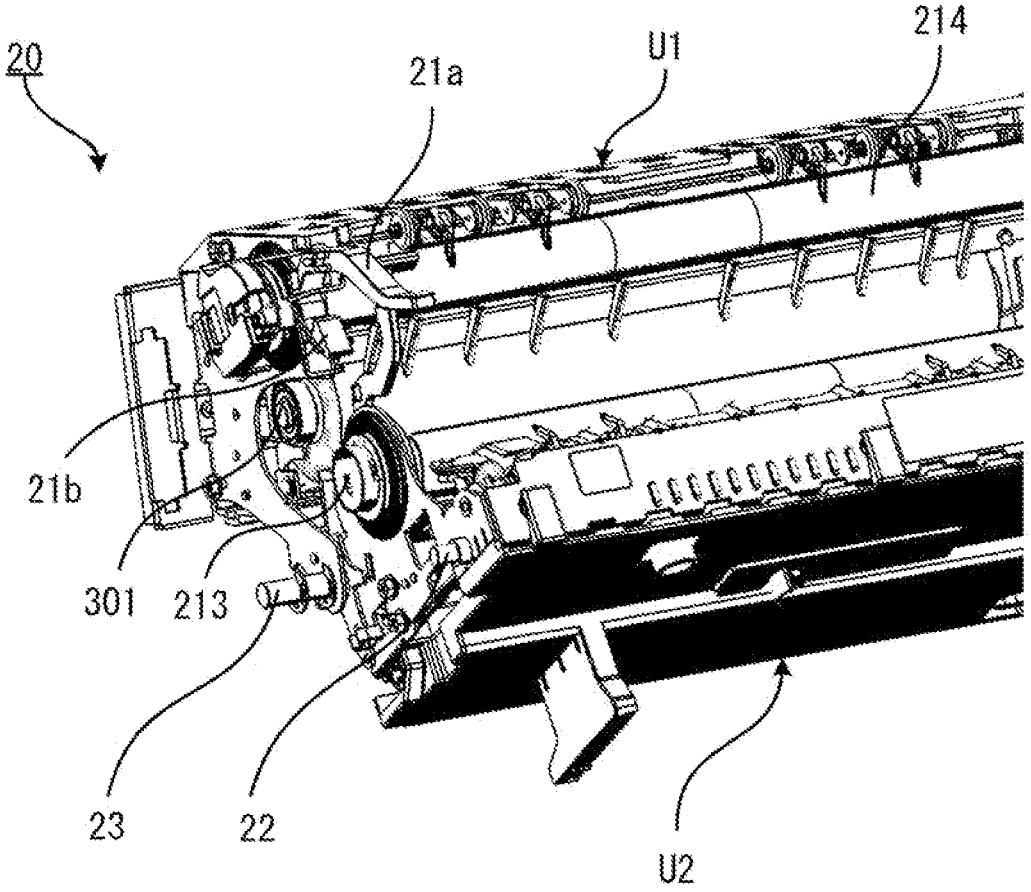
FIG. 5 is a perspective view of the heating device illustrated in FIG. 1 when the heating device is opened.

As illustrated in FIG. 3 and FIG. 4, opening and closing levers 21 are provided on both end portions of the inside unit U1 of the heating device 20 such that an operator can manually open and close the heating device 20. An elongated rod-shaped operating portion 21*a* is formed on one end of the opening and closing lever 21 so that the operator can apply a force by grabbing the operating portion 21*a*, and a hook-shaped hook portion 21*b* which is engaged with an eccentric shaft 22 is formed on the other end of the opening and closing lever. When the operating portion 21*a* of the opening and closing lever 21 illustrated in FIG. 4 is pushed down in a direction of an arrow D, the engagement of the eccentric shaft 22 with the hook portion 21*b* is released. Then, the outside unit U2 of the heating device 20 rotates around a rotating shaft 23 with the self weight and is separated from the inside unit U1. As a result, as illustrated in FIG. 5, the first heat roller 213 and the second heat roller 214 are opened and a jammed sheet can be taken out.

Figure 6:
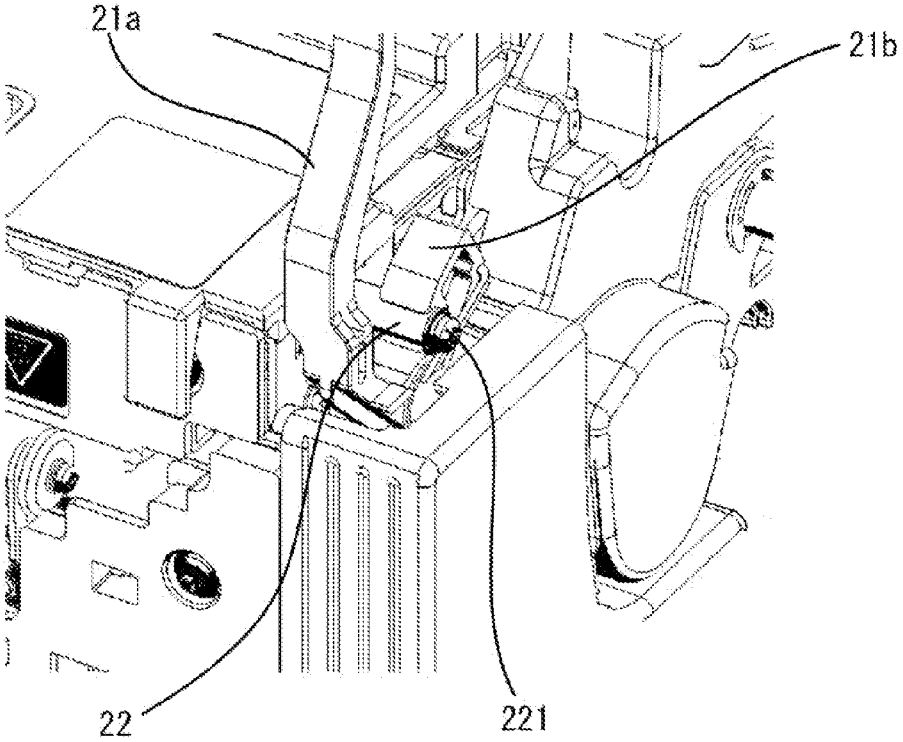
FIG. 6 is an enlarged perspective view illustrating a connection state of an opening and closing lever and an eccentric shaft in the heating device illustrated in FIG. 1.
Figure 7:
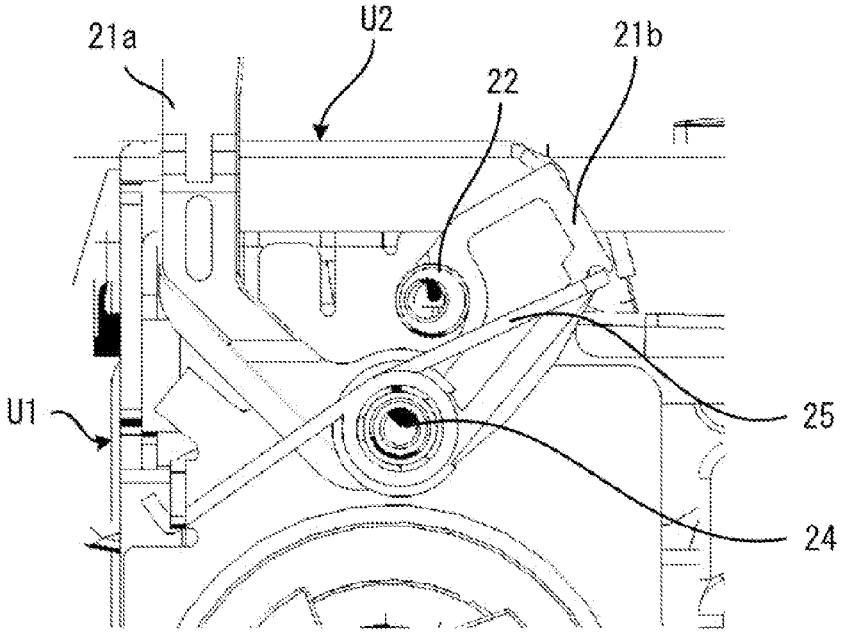
FIG. 7 is a side view illustrating the connection state of the opening and closing lever and the eccentric shaft illustrated in FIG. 6.

Next, description will be given with regard to a nip width adjustment structure in the above-described heating device 20. As illustrated in FIG. 6, when the hook portion 21*b* of the opening and closing lever 21 is engaged with the eccentric shaft 22, the heating device 20 is in a closed state. In addition, as illustrated in FIG. 7, a torsional spring 25 which elastically deforms depending on a force applied to the operating portion 21*a* is wound around a rotating shaft 24 of the opening and closing lever 21. One end of the torsional spring 25 is connected to a frame of the inside unit U1 and the other end of the torsional spring is connected to the hook portion 21*b* of the opening and closing lever 21. If the heating device 20 is opened, the engagement of the eccentric shaft 22 and the hook portion 21*b* is released by the operator pushing the operating portion 21*a* from this state to rotate the operating portion clockwise.

Figure 8:
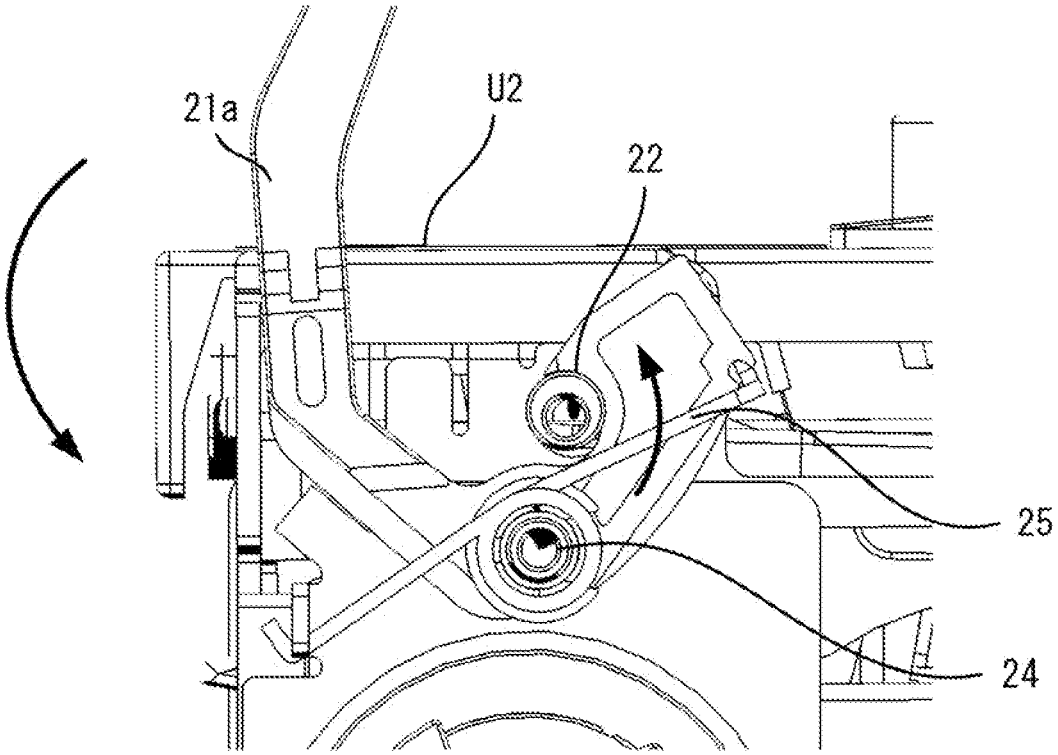
FIGS. 8 and 9 are side views describing a change in the center position of the eccentric shaft in the connection state of the opening and closing lever and the eccentric shaft illustrated in FIG. 7.

If the operating portion 21*a* rotates counterclockwise from the engaged state illustrated in FIG. 7, the state is brought into the engaged state illustrated in FIG. 8. Since the hook portion 21*b* of the opening and closing lever 21 is more firmly engaged with the eccentric shaft 22 in the engaged state of FIG. 8 compared to the engaged state of FIG. 7, the outside unit U2 is lowered in the engaged state of FIG. 8. As a result, a nip width in the first erasing unit 201 and the second erasing unit 202 increases.

Figure 9:
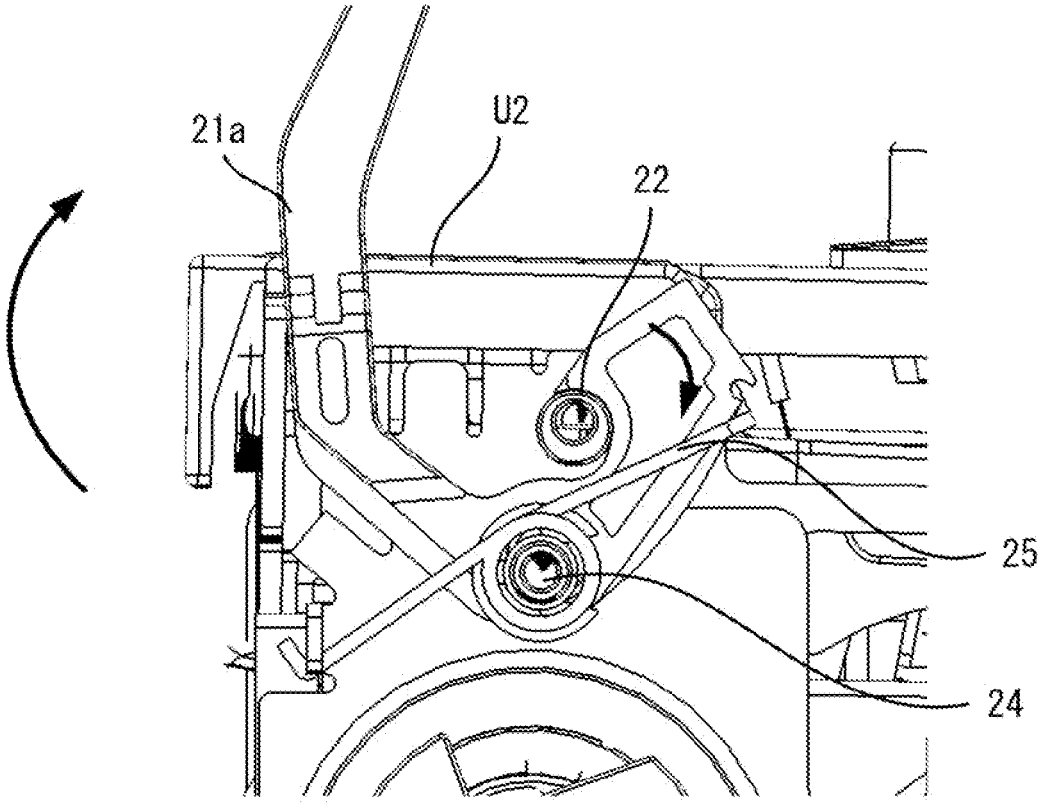

On the other hand, if the operating portion 21*a* is rotated clockwise from the engaged state illustrated in FIG. 7, the state is brought into the engaged state illustrated in FIG. 9. Since the hook portion 21*b* of the opening and closing lever 21 is less firmly engaged with the eccentric shaft 22 in the engaged state of FIG. 9 compared to the engaged state of the FIG. 7, the outside unit U2 is lifted in the engaged state of FIG. 9. As a result, the nip width in the first erasing unit 201 and the second erasing unit 202 decreases.

Here, the opening and closing lever 21 is fixed in the following steps of (1) to (4).

(1) The eccentric shaft 22 is positioned in an appropriate position.

(2) After the eccentric shaft 22 is positioned, the eccentric shaft is fixed by a fixing screw 22*a* in its center. Specifically, a groove (not illustrated) in which a flathead screw driver or the like can be inserted is formed on the eccentric shaft 22 in advance, the eccentric shaft 22 can be positioned in a desired position by the operator fixing the fixing screw 22*a* in the groove.

(3) After the eccentric shaft 22 is fixed by the fixing screw 22*a*, the position of the eccentric shaft 22 is fixed.

(4) Since the fixed eccentric shaft 22 does not rotate, the engagement of the hook portion 21*b* with the eccentric shaft 22 is also fixed.

Therefore, in the heating device 20 according to the present embodiment, it is possible to adjust a fixing position of the outside unit U2 including the second press roller 302 by operating the opening and closing lever 21 which is placed on both left and right ends of the heating device 21. That is, it is possible to adjust the nip width of the second erasing unit 202 by adjusting a pressure of the second press roller 302 independently on both the left and right ends. In addition, since the opening and closing lever 21 and the eccentric shaft 22 are disposed on the outside of a heat source cover covering an end portion of the second heat roller 214, it is possible to simply adjust the nip width from the outside of the heating device without removing the heat source cover. The nip width of the second press roller contained in the outside heat source (second erasing unit 202) has a great impact on occurrence of wrinkles. However, it is possible to suppress the occurrence of wrinkles by adjusting the nip width as described above.

Second Embodiment

Hereinafter, description will be given with regard to a heating device 20 according to a second embodiment. Since reference numerals in common with the reference numerals in the first embodiment indicate the same subjects, the points which are different from the first embodiment will be described in detail.

Figure 10:
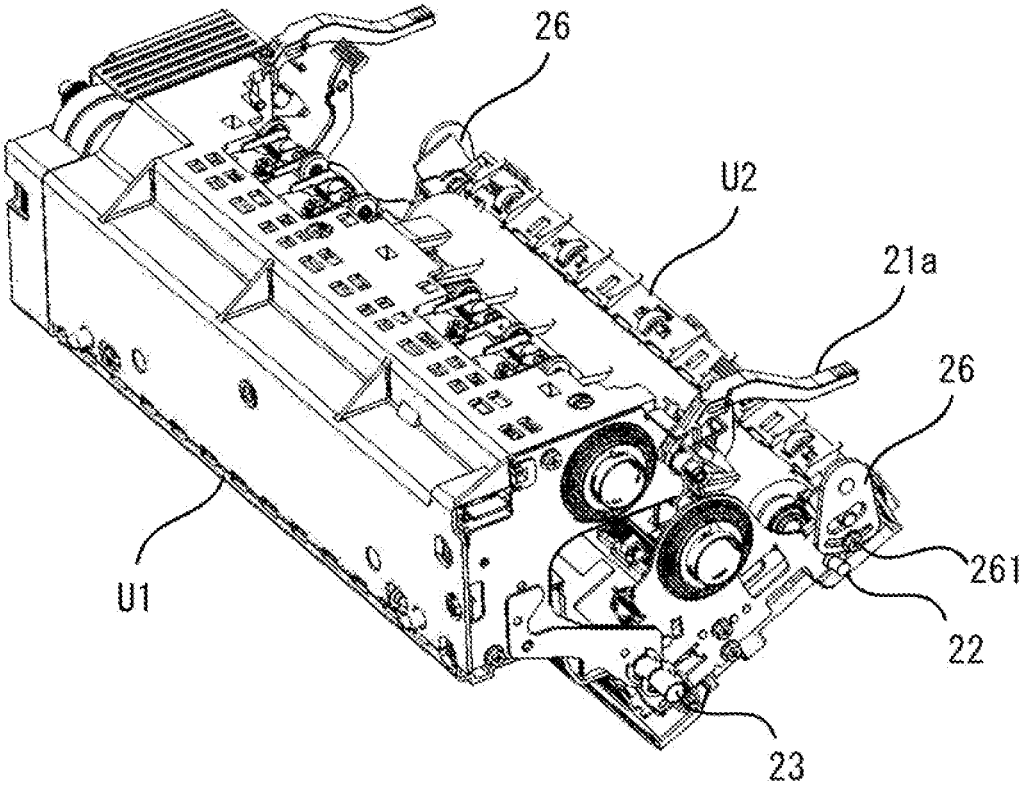
FIG. 10 is a perspective view of a heating device according to a second embodiment when the heating device is opened.

As illustrated in FIG. 10, the heating device 20 according to the second embodiment also includes a first nip width adjustment member 26 on each end portion of the second press roller in a rotating shaft direction. The first nip width adjustment member 26 adjusts a nip width between the second press roller 302 and the second heat roller 214.

Figure 11:
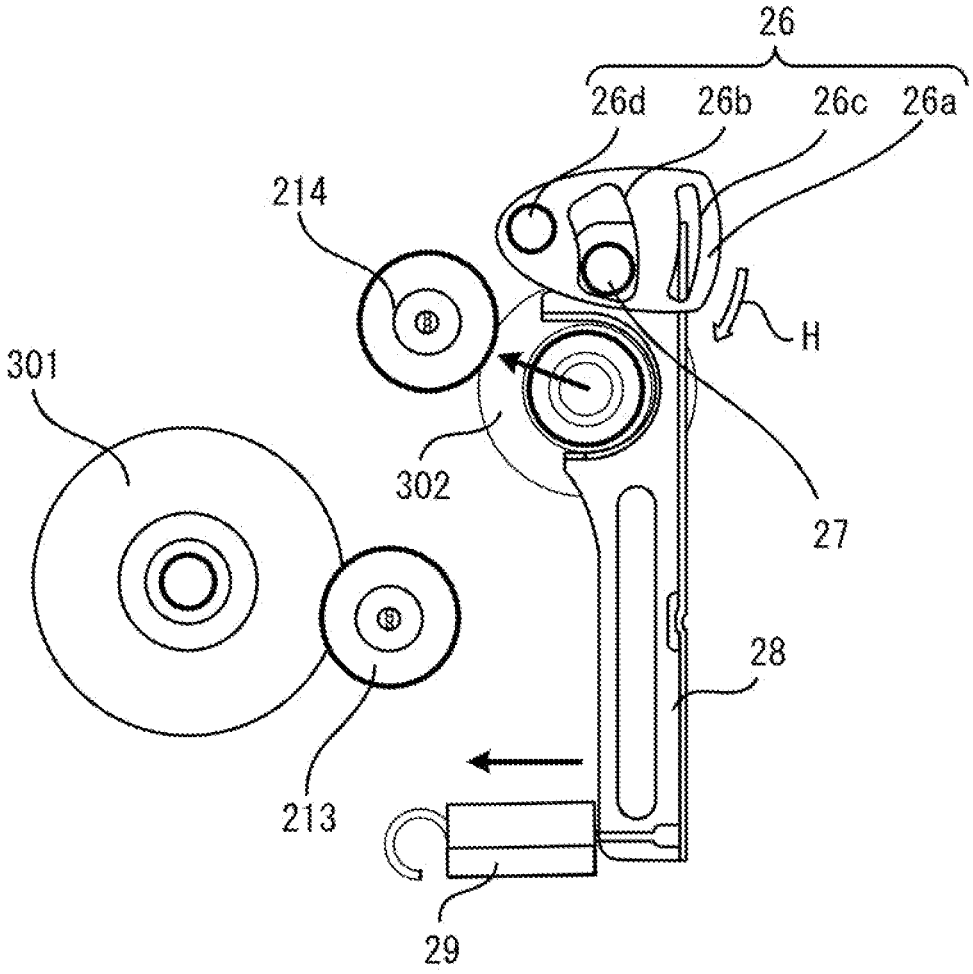
FIGS. 11 and 12 are schematic views describing a nip width adjustment structure of the heating device illustrated in FIG. 10.

As illustrated in FIG. 10 and FIG. 11, a plate 26*a* includes a first slit hole 26*b* to adjust a position of a pressure member rotating shaft 27 of a pressure member frame 28 holding an end portion of the second press roller 302 and a second slit hole 26*c* to adjust a position of a fixing screw 261 for fixing the first nip width adjustment member 26 to a frame of the heating device 20 (outside unit U2). The plate 26*a* is a main component of the first nip width adjustment member 26. In addition, the first nip width adjustment member 26 has an adjustment member rotating shaft 26*d* which rotatably fixes the plate 26*a* to the frame of the outside unit U2.

When a lower end of the pressure member frame 28 is pulled by a pressure spring 29 for a second heat source, the pressure member frame 28 is rotated around the rotating shaft 27, and a pressure is applied to the second heat roller 214 by the second press roller 302.

If it is desired to increase the pressure applied by the second press roller 302 compared to a state illustrated in FIG. 11, the plate 26*a* is rotated clockwise (arrow H direction) around the adjustment member rotating shaft 26*d*. Since the rotating shaft 27 of the pressure member frame 28 slides along the first slit hole 26*b* and the second press roller 302 approaches the second heat roller 214, the pressure applied by the second press roller 302 is increased and the nip width is increased.

Figure 12:
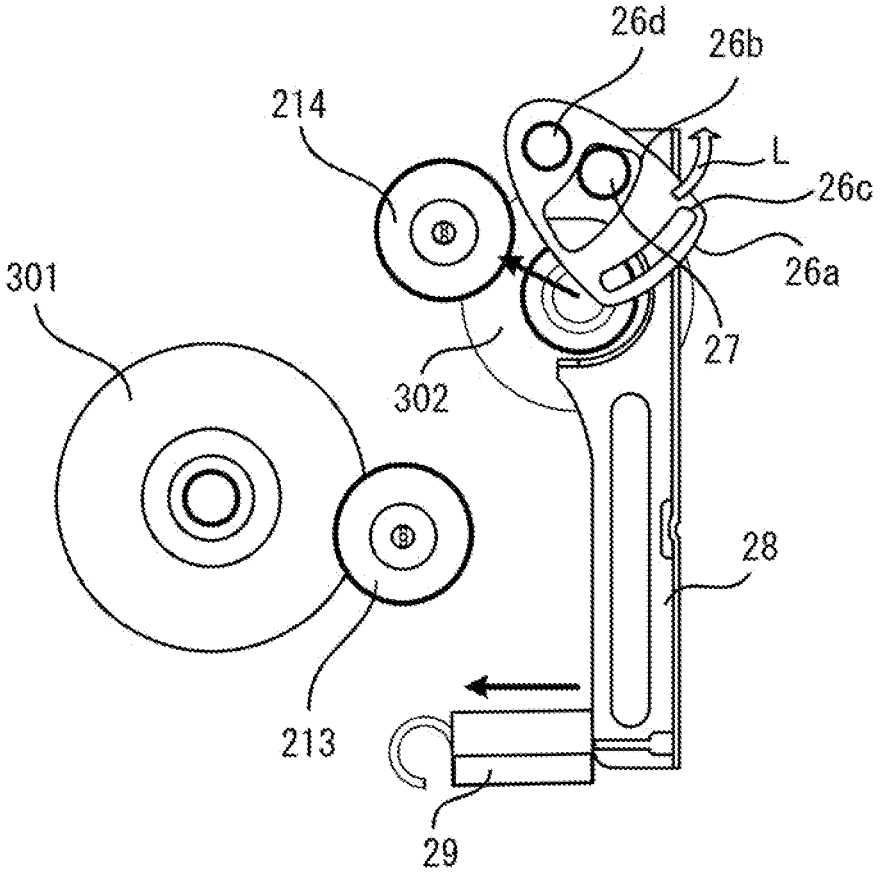

Conversely, if it is desired to decrease the pressure applied by the second press roller 302 compared to a state illustrated in FIG. 12, the plate 26*a* is rotated counterclockwise (arrow L direction) around the adjustment member rotating shaft 26*d*. Since the rotating shaft 27 of the pressure member frame 28 slides along the first slit hole 26*b* and the second press roller 302 is separated from the second heat roller 214, the pressure applied by the second press roller 302 is decreased and the nip width is decreased. After completion of the adjustment, the position of the plate 26*a* is fixed as illustrated in FIG. 10 by passing the screw 261 through the fixing slit hole 26*c*.

Therefore, according to the heating device 20 according to the present embodiment, since the first nip width adjustment member 26 is provided on both left and right ends of the second press roller 302, it is possible to optimize the nip width by independently adjusting the pressure applied by the second press roller 302 on both left and right ends without removing the pressure spring 29.

Third Embodiment

Hereinafter, description will be given with regard to a heating device 20 according to a third embodiment.

Figure 13:
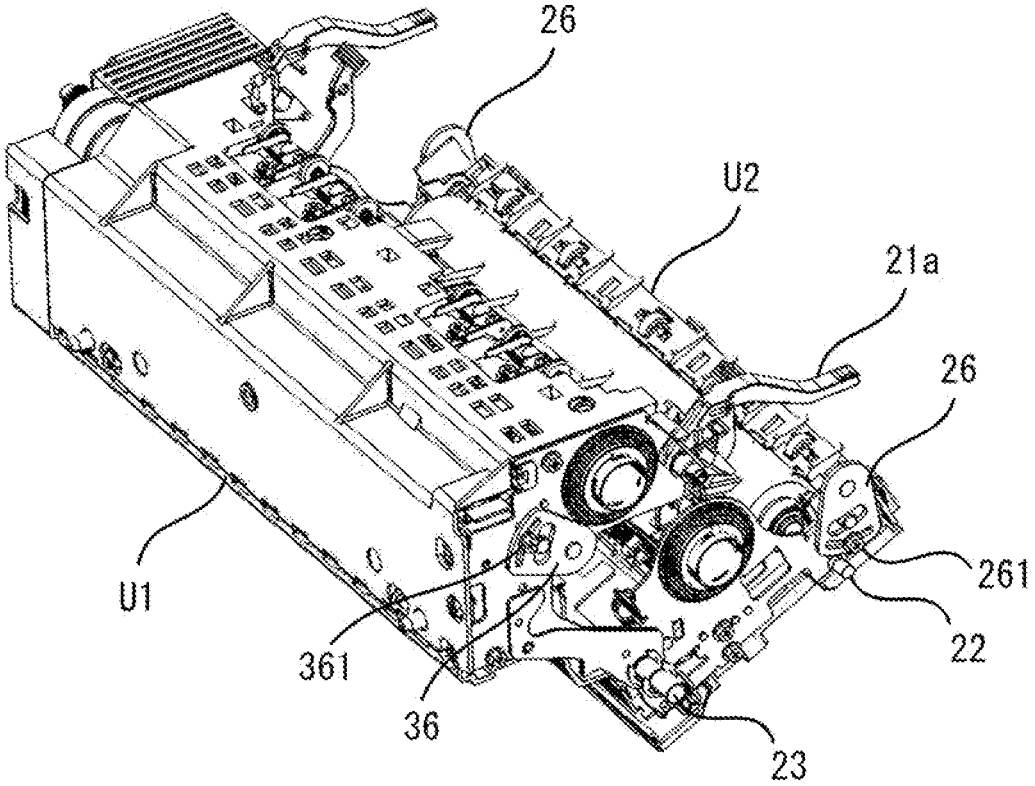
FIG. 13 is a perspective view of a heating device according to a third embodiment that is opened.

The heating device 20 illustrated in FIG. 13 further includes a second nip width adjustment member 36 to adjust a nip width between the first press roller 301 and the first heat roller 213 on both end portions of the first press roller 301 in a rotating shaft direction.

Figure 14:
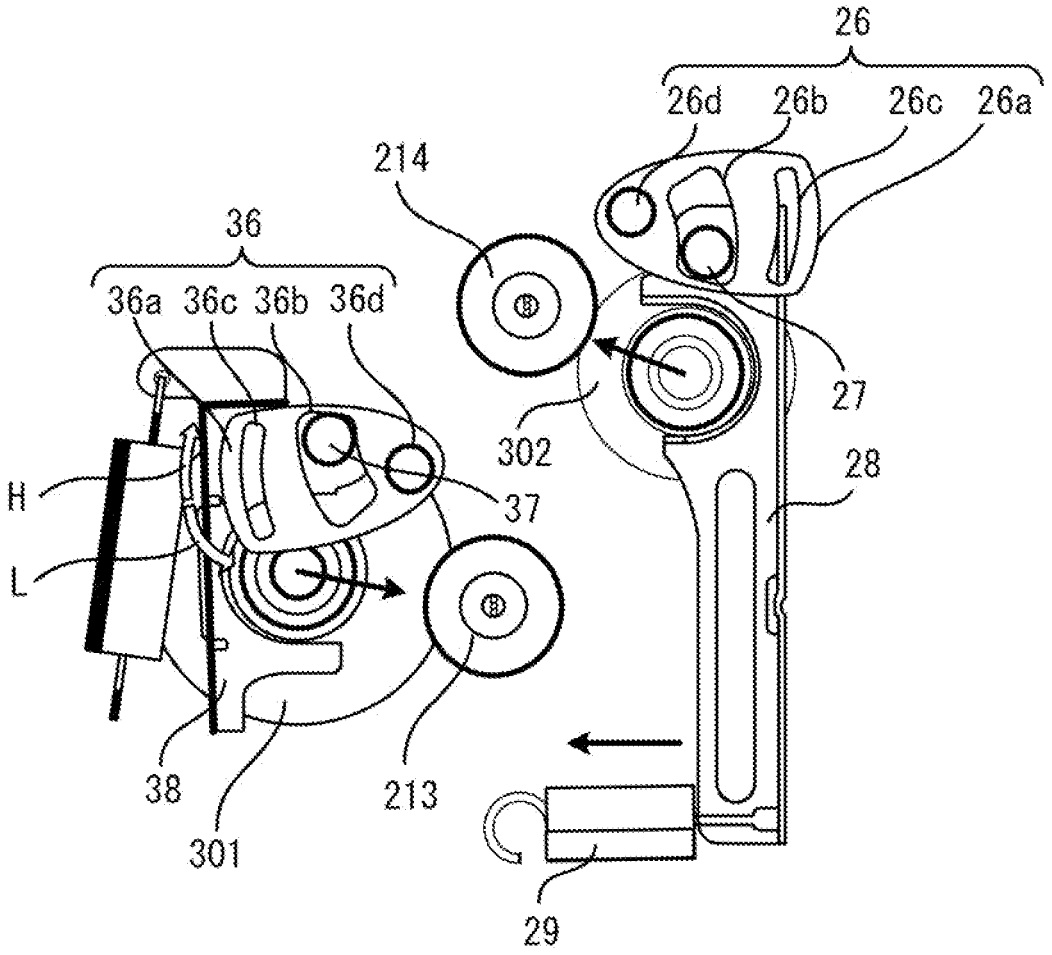
FIG. 14 is a schematic view describing a nip width adjustment structure of the heating device illustrated in FIG. 13.

As illustrated in FIG. 13 and FIG. 14, a plate 36*a* includes a first slit hole 36*b* to adjust a position of a rotating shaft 37 of a pressure member frame 38 holding an end portion of the first press roller 301 and a second slit hole 36*c* to adjust an position of a fixing screw 361 for fixing the second nip width adjustment member 36 to a frame of the heating device 20 (inside unit U1). The plate 36*a* is a component of the second nip width adjustment member 36. An adjustment member rotating shaft 36*d* rotatably fixes the plate 36*a* to the frame of the inside unit U1.

If it is desired to increase a pressure applied by the first press roller 301 compared to a state illustrated in FIG. 14, the plate 36*a* is rotated clockwise (arrow H direction) around the adjustment member rotating shaft 36*d*. Since the rotating shaft 37 of the pressure member frame 38 slides along the first slit hole 36*b* and the first press roller 301 approaches the first heat roller 213, the pressure applied by the first press roller 301 is increased and a nip width is increased.

Conversely, if it is desired to decrease the pressure applied by the first press roller 301, the plate 36*a* is rotated counterclockwise (arrow L direction) around the adjustment member rotating shaft 36*d*. Since the rotating shaft 37 of the pressure member frame 38 slides along the first slit hole 36*b* and the first press roller 301 is separated from the first heat roller 213, the pressure applied by the first press roller 301 is decreased and the nip width is decreased. After completion of the adjustment, the position of the plate 36*a* is fixed by the screw 361 being tightened in the fixing slit hole 36*c*.

In this manner, it is possible to independently adjust a nip width of the first heat source as well as the second heat source on both the left and right ends by providing the second nip width adjustment members 36 at the first heat source side.

Fourth Embodiment

Figure 15:
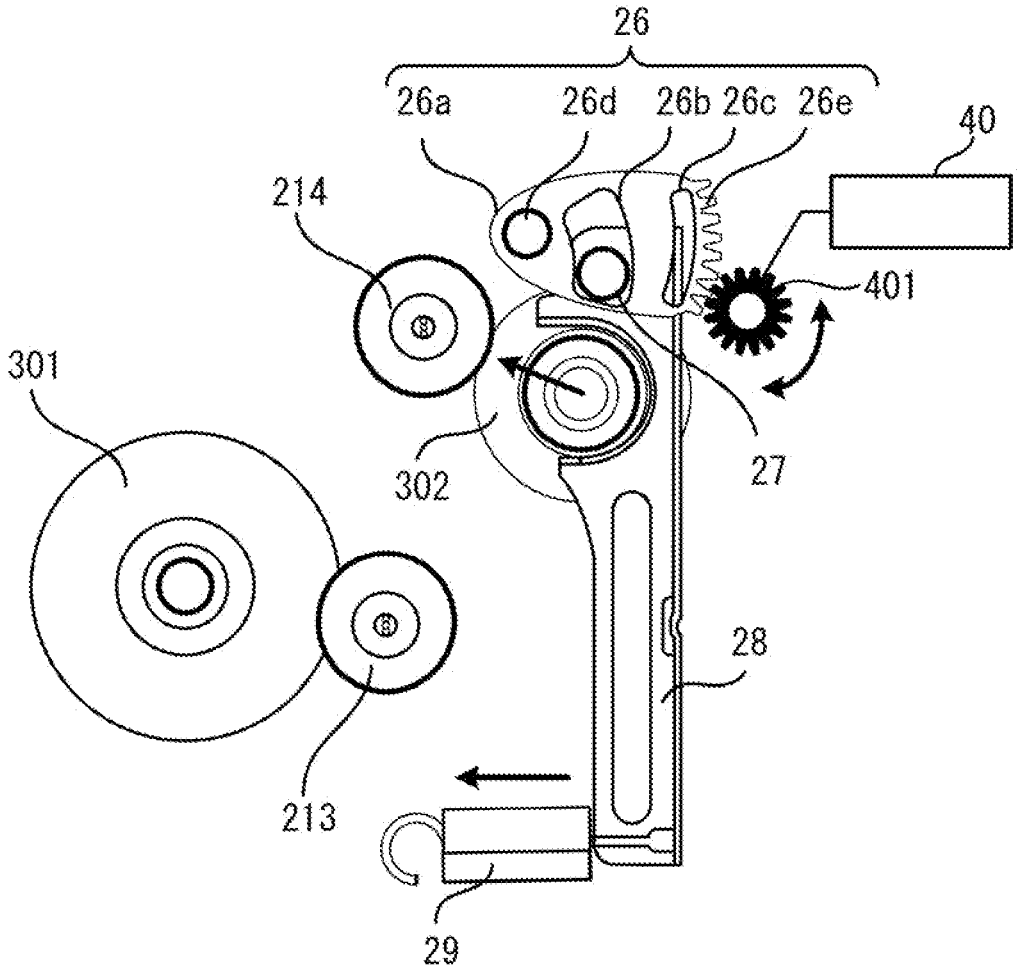
FIG. 15 is a schematic view describing the nip width adjustment structure of the heating device according to a fourth embodiment.

In the above-described embodiments, the nip width is manually adjusted. In addition, a configuration with a mechanically-driven adjustment also conceivable. A gear train 26*e* is formed on one end of the first nip width adjustment member 26 of the heating device 20 illustrated in FIG. 15 and a gear 401 of a driving device 40 is engaged with the gear train 26*e*. A motor (not illustrated) which drives the gear 401 based on control signals input from outside is built into the driving device 40. The gear 401 is driven by the motor, and the plate 26*a* is rotated around the adjustment member rotating shaft 26*d*.

If it is desired to increase a pressure applied by the second press roller 302, the plate 26*a* is rotated clockwise around the adjustment member rotating shaft 26*d* by the driving device 40 driving the gear 401 to rotate counterclockwise. Conversely, if it is desired to decrease the pressure applied by the second press roller 302, the plate 26*a* is rotated counterclockwise around the adjustment member rotating shaft 26*d* by the driving device 40 driving the gear 401 to rotate clockwise. In this manner, it is possible to mechanically adjust the nip width by driving the first nip width adjustment member 26 using the driving device 40. The heating device 20 is incorporated into the erasing apparatus 10 in FIG. 1, but it is possible to quickly adjust the nip width without removing the heating device 20.

In addition, it is possible to apply the structure of the nip width adjustment in the above-described heating device 20 to a fixing device incorporated into an image forming apparatus that employs an electrophotographic process, such as a copying machine, a facsimile, and a printer. In general, a fixing device has a pair of rollers including a heat roller and a press roller, conveys one sheet into a nip formed between the pair of rollers, pressurizes a toner image onto the sheet while heating the toner image, and fixes the toner onto the sheet. Therefore, if the fixing device includes a heating device opening and closing mechanism between the heat roller and the press roller, it is possible to easily perform the adjustment of the nip width by applying a connection structure of the opening and closing lever 21 and the eccentric shaft 22, which are described in the first embodiment, to the heating device opening and closing mechanism. In the same manner, it is possible to provide the nip width adjustment member 26 described in the second embodiment on the end portion of the press roller of the fixing device.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A heating device, comprising:

a first heating roller configured to heat a first surface of a sheet;

a second heating roller configured to heat a second surface of the sheet, the second heating roller disposed downstream in a sheet conveying direction with respect to the first heating roller;

a first pressing roller configured to press the sheet against the first heating roller, the first pressing roller and the second heating roller forming a first unit;

a second pressing roller configured to press the sheet against the second heating roller, the second pressing roller and the first heating roller forming a second unit that is rotatable about a rotational axis relative to the first unit;

an eccentric shaft unit disposed on one of the first unit and the second unit and extending in a direction parallel to the rotational axis, a rotational position of an eccentric portion of the eccentric shaft unit being changeable; and an engaging unit disposed on the other one of the first unit and the second unit, and configured to engage with the eccentric shaft, a position of the second unit relative to the first unit being adjusted when the rotational position of the eccentric portion of the eccentric shaft unit is changed.

2. The heating device according to claim 1, wherein:

the eccentric shaft unit includes a first eccentric shaft disposed at a first end of the one of the first or second unit in the direction along the rotational axis and a second eccentric shaft disposed at a second end of the one of the first or second unit, and the engaging unit includes a first engaging unit configured to engage with the first eccentric shaft and a second engaging unit configured to engage with the second eccentric shaft.

3. The heating device according to claim 1, further comprising:

an urging unit configured to urge the second pressing roller towards the second heating roller; and an adjusting unit configured to adjust a pressure with which the second pressing roller presses the sheet towards the second heating roller, depending on a position of the urging unit relative to the second unit.

4. The heating device according to claim 3, further comprising:

a driving unit configured to change a position of the urging unit relative to the second unit.

5. The heating device according to claim 1, further comprising:

an urging unit configured to urge the first pressing roller towards the first heating roller; and an adjusting unit configured to set a pressure with which the first pressing roller presses the sheet towards the first heating roller, depending on a position of the urging unit relative to the first unit.

6. The heating device according to claim 5, further comprising:

a driving unit configured to change a position of the urging unit relative to the first unit.

7. The heating device according to claim 1, further comprising:

a handle with which a user can change the rotational position of the eccentric portion.

8. The heating device according to claim 1, wherein the first and second units are each configured to fix a toner image on the sheet.

9. An erasing apparatus, comprising:

a sheet conveying unit configured to convey a sheet; and an erasing unit configured to erase an image formed on the sheet, the erasing unit including:

a first heating roller configured to heat a first surface of a sheet, a second heating roller configured to heat a second surface of the sheet, the second heating roller disposed downstream in a sheet conveying direction with respect to the first heating roller, a first pressing roller configured to press the sheet against the first heating roller, the first pressing roller and the second heating roller forming a first unit, and a second pressing roller configured to press the sheet against the second heating roller, the second pressing roller and the first heating roller forming a second unit positioned around a rotational axis and rotatable relative to the first unit;

an eccentric shaft unit disposed on one of the first unit and the second unit and extending in a direction parallel to the rotational axis, a rotational position of an eccentric portion of the eccentric shaft unit being changeable; and an engaging unit disposed on the other one of the first unit and the second unit, and configured to engage with the eccentric shaft, a position of the second unit relative to the first unit being adjusted when the rotational position of the eccentric portion of the eccentric shaft unit is changed.

10. The erasing apparatus according to claim 9, wherein:

the eccentric shaft unit includes a first eccentric shaft disposed at a first end of the one of the first or second unit in the direction along the rotational axis and a second eccentric shaft disposed at a second end of the one of the first or second unit in the direction, and the engaging unit includes a first engaging unit configured to engage with the first eccentric shaft and a second engaging unit configured to engage with the second eccentric shaft.

11. The erasing apparatus according to claim 9, wherein the erasing unit further includes, an urging unit configured to urge the second pressing roller towards the second heating roller; and an adjusting unit configured to adjust a pressure with which the second pressing roller presses the sheet towards the second heating roller, depending on a position of the urging unit relative to the second unit.

12. The erasing apparatus according to claim 11, further comprising:

a driving unit configured to change a position of the urging unit relative to the second unit.

13. The erasing apparatus according to claim 9, further comprising:

an urging unit configured to urge the first pressing roller towards the first heating roller; and an adjusting unit configured to set a pressure with which the first pressing roller presses the sheet towards the first heating roller, depending on a position of the urging unit relative to the first unit.

14. The erasing apparatus according to claim 13, further comprising:

a driving unit configured to change a position of the urging unit relative to the first unit.

15. The erasing apparatus according to claim 9, further comprising:

a handle with which a user can change the rotational position of the eccentric portion.

* * * * *